US005546660A

United States Patent [19]

Burout et al.

[11] Patent Number: 5,546,660

[45] Date of Patent: Aug. 20, 1996

[54] DYNAMIC RAZOR HEAD

[75] Inventors: Charles Burout, Knoxville, Tenn.; Ernest Ortiz, Cheshire, Conn.

[73] Assignee: Warner-Lambert Company

[21] Appl. No.: 315,735

[22] Filed: Sep. 30, 1994

[51] Int. Cl.[6] ..... B26B 21/22

[52] U.S. Cl. ..... 30/50; 30/48

[58] Field of Search ..... 30/34.2, 47–50, 30/346.57

[56] References Cited

U.S. PATENT DOCUMENTS

| | | | |
|---|---|---|---|
| 3,842,502 | 10/1974 | Hagan | 30/346.57 |
| 4,774,265 | 10/1988 | Ferraro | 30/50 |
| 5,222,300 | 6/1993 | Althaus et al. | 30/50 |
| 5,249,361 | 10/1993 | Apprille et al. | 30/34.2 X |
| 5,313,706 | 5/1994 | Motta et al. | 30/50 X |
| 5,347,714 | 9/1994 | Prochaska | 30/50 |

*Primary Examiner*—Douglas D. Watts
*Attorney, Agent, or Firm*—Charles W. Almer

[57] ABSTRACT

A razor head comprising a support structure having side portions positioned outside the cutting path of the blade edges and which are formed of a resilient material, for example, a synthetic rubber-like compound. By positioning resilient material in skin-engaging contact on the sides of the razor head support structure outside the cutting path of the blades, a soothing sensation is advantageously imparted to the shaving process and a higher degree of control over the skin as the skin flows over the blades, is attainable.

Another aspect of the present invention comprises, a resilient material utilized in the construction of the support structure at a pivotal connection between two relatively movable members in order to dampen vibrations. Other embodiments comprise a plurality of operatively connected blades.

5 Claims, 4 Drawing Sheets

DYNAMIC RAZOR HEAD

The present invention is directed to razor heads used for shaving.

BACKGROUND OF THE INVENTION

Some razor heads available on the market, including disposable cartridges, have been formed in recent years with one or more dynamic elements. For example, some disposable cartridges are formed with blades or other skin-engaging elements which move in relation to the supporting structure of the cartridge in response to forces encountered during shaving. One disadvantage of systems now marketed incorporating dynamic blades and guard members is the relatively high number of pieces which must be separately manufactured and then assembled during manufacturing. It would be highly desirable to provide a shaving system capable of providing a close, comfortable shave which does not require as many separate assembly steps.

It is also now conventional in the manufacture of safety razors to provide a guard bar or guard member at a position in the razor head structure so that the guard member contacts the surface being shaved before the forward-most blade. The distance between the skin-engaging surface of the guard member and the adjacent blade affects the angle at which the blade edge contacts the skin. Though it has been suggested to use various materials in the formation of such guard members, the guard member is only one portion of the skin-engaging structure of a typical razor head. Previously disclosed systems have not attempted to achieve better skin flow control over the sharpened edges of the blades by modifying materials used in other portions of the cartridge support structure.

Furthermore, previously disclosed dynamic shaving systems typically utilize relatively rigid materials, such as polypropylene or metal at the locations where a movable, skin-engaging element contacts the supporting structure of the razor head. It is believed that the use of rigid materials for these portions of the razor head increases the likelihood of vibrations, commonly referred to as "chattering" with respect to blades. "Blade chatter" refers to undesirable vibratory-like movements of the blade as the blade is drawn across a skin surface. Such vibratory movements are undesirable since vibrations of the blade detract from the smooth, even cutting of hair. It would therefore be desirable to provide a razor head designed to dampen the likelihood of such vibratory-like movements of a blade.

SUMMARY OF THE INVENTION

The various embodiments of the present invention comprise razor heads and methods of manufacturing razor heads which are designed to deliver close, comfortable shaves.

One embodiment of the present invention comprises a method of forming a razor head with a support structure having side portions positioned outside the cutting path of the blade edges and which are formed of a resilient material, for example, a synthetic rubber-like compound which is resilient and has a higher coefficient of friction with skin-surfaces than conventional, rigid polymers such as polypropylene. It has been found that by positioning resilient material in skin-engaging contact on the sides of the razor head support structure outside the cutting path of the blades that a soothing sensation is advantageously imparted to the shaving area. Furthermore, by providing a higher coefficient of friction between the sides of the razor head support structure and the skin surface being shaved, it is possible to achieve a higher degree of control over the skin as the skin flows over the blades, particularly the cap or trailing blade(s).

According to another aspect of the present invention, a resilient material is utilized in the construction of the support structure in an area of connection between two relatively movable members. For example, some embodiments of the present invention comprise blades supported by blade supports which are pivotally connected to the support structure of the razor head. The blade supports are received within receptacles in the inner sidewalls of the support structure. Instead of forming the blade support and the corresponding receptacle in the inner sidewalls of the support structure of a rigid material, such as polypropylene or a metal, the receptacles and/or the pins are formed of a resilient material such as a rubber-like synthetic. Those skilled in the art will appreciate that by using a resilient material having a higher coefficient of friction with the pins of the blade support, these embodiments of the present invention advantageously dampen the vibratory characteristics of the blades.

According to another preferred embodiment of the present invention, a frame is formed of a conventional, rigid thermoplastic material, such as polypropylene, and then a resilient material is attached, for example, via insert molding, to selected portions of the frame.

Another advantageous aspect of embodiments of the present invention lies in the ease in which these embodiments can be manufactured, for example, by insert molding processes which greatly minimize the time, labor and subcomponents required for manufacture.

The various embodiments of dynamic razor heads are capable of providing safe, close and comfortable shaves utilizing rigid and/or flexible blades.

These and other embodiments of the present invention are described below with reference to the figures.

DETAILED DESCRIPTION

The present invention comprises novel razor heads and methods of forming razor heads designed to provide safe, close and comfortable shaves. As used herein, the term "razor head" is meant to include the operative cutting portion of a shaving system including razor cartridges designed for attachment to a separate razor as well as those which are integrally formed with a handle as in, for example, a conventional, disposable razor.

Figure 1:
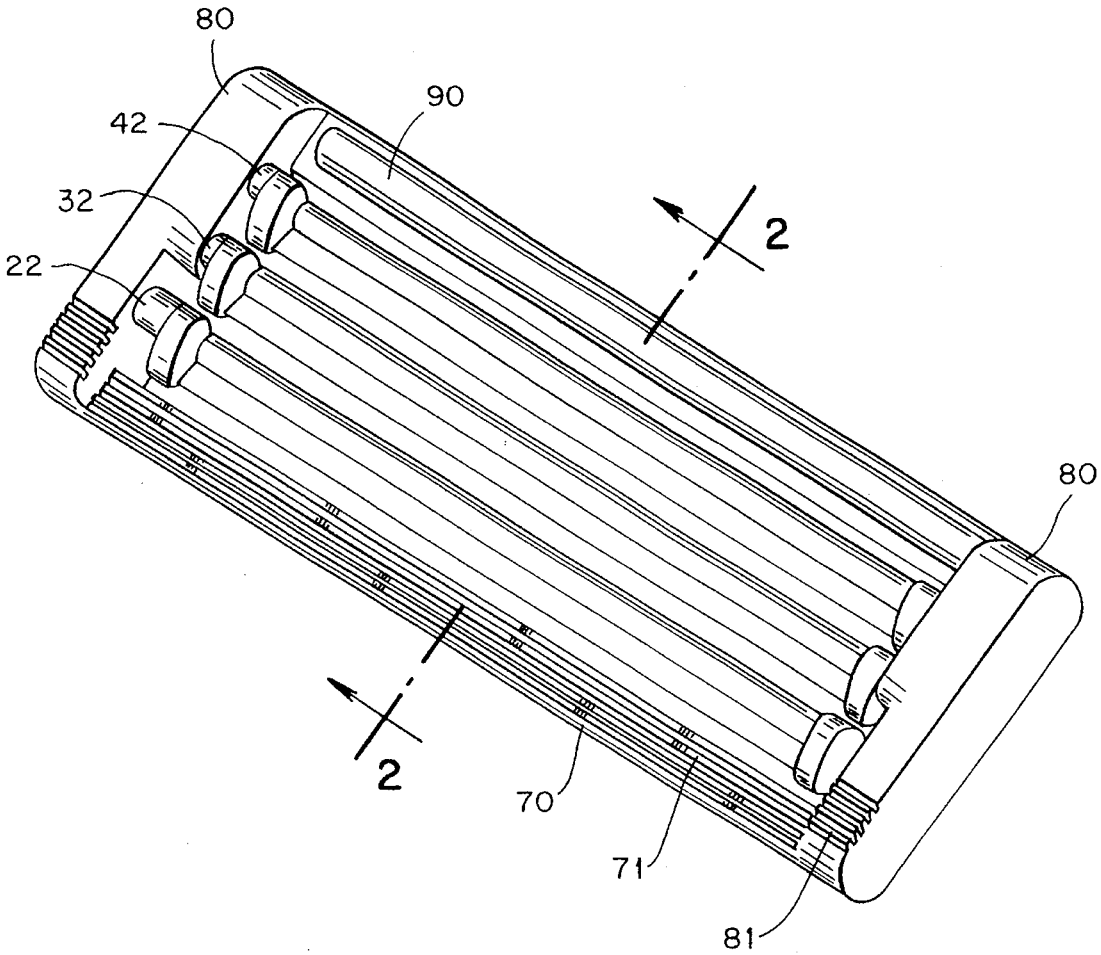
FIG. 1 is an perspective view of one embodiment of the present invention.
Figure 2:
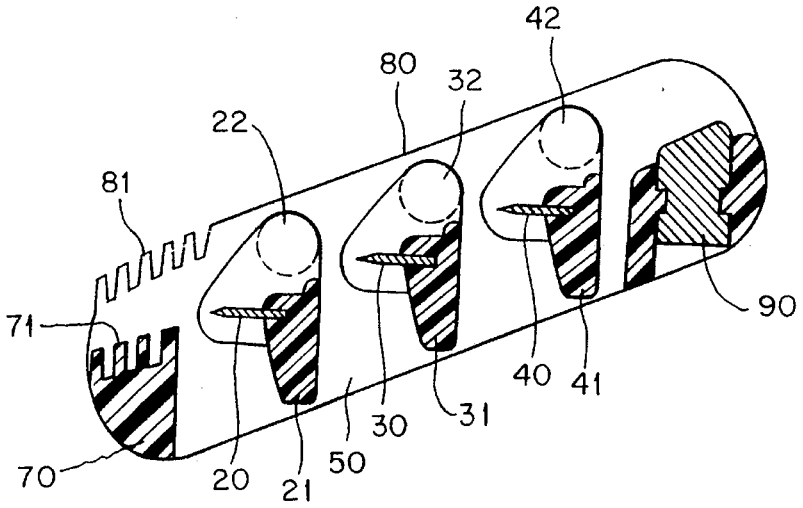
FIG. 2 is a cross-sectional view taken along lines 2—2 of FIG. 1.

One embodiment of the present invention is illustrated in FIGS. 1 and 2, wherein three blades 20, 30 and 40 are independently supported for pivotal movement by three blade supports 21, 31 and 41, respectively. These blade supports are connected via torsion members 22, 32, 42, to a cartridge support structure 50. The blades of this embodiment of the present invention are arranged in substantially parallel, spaced relationship for sequentially contacting the skin surface being shaved.

A resilient forward guard member 70 is positioned forwardly of the first blade 20 in order to control the angle at which the skin surface contacts the cutting edge of forward blade 20. Forward guard member 70 is advantageously formed with a plurality of protrusions 71 positioned for skin-engaging contact. According to this illustrated embodiment of the present invention, the protrusions 71 of guard member 70 extend upwardly, substantially perpendicular to the cutting path of the blades.

In addition to forward guard member 70, the major portion of which is positioned within the cutting path of the blades, this embodiment of the present invention is also provided with resilient, skin-engaging, side portions 80 disposed outside of the cutting path of the blades on skin-engaging side portions of the cartridge support structure 50. According to this and other illustrated embodiments of the present invention, the resilient side portions 80 are advantageously positioned higher than the sharpened blade edges, as best shown in the side view of FIG. 2. The face-engaging portions of guard member 70 and the cutting edges of the blades are recessed relative to the resilient side portions 80. In this manner, the resilient side portions 80 of the cartridge support structure 50 are positioned to engage skin surfaces adjacent to the area of skin being shaved. Those skilled in the art will appreciate that a resilient material, such as a synthetic rubber-like compound, is capable of providing a higher coefficient of friction than conventional rigid engineering thermoplastics, such as polystyrene or ABS, typically used for cartridge support structures. The resilient material of the present material is advantageously designed to provide a more detectable sensation to the skin in a manner which will tend to mask any unpleasant feeling of a sharpened blade traveling across the skin. Furthermore, the higher coefficient of friction of the resilient material used on resilient side portions 80 enables these side portions to grip the skin and exert greater control of the skin as it flows over the blade(s). The overall result of this aspect of the present invention is to provide enhanced skin flow control and to minimize unpleasant sensory perceptions which have previously been associated with shaving.

As illustrated in FIGS. 1 and 2, a portion of resilient side portions 80 may be formed as resilient protrusions 81 in a manner similar to the resilient protrusions 71 of forward guard member 70. In the illustrated embodiment, a forward section of resilient side portion 80 comprises upwardly projecting protrusions 81 which are substantially parallel to protrusions 71 of guard member 70. While the illustrated protrusions 81 extend for only a portion of side portion 80, side protrusions 81 may be formed along the entire face-engaging portion of side portion 80. Furthermore, the orientation of side protrusions 81 may be parallel to the cutting path, either identical or different from the direction of protrusions 71 of guard member 70.

The resilient materials used for forward guard member 70 and resilient side portions 80 can be formed of resilient materials which have a higher coefficient of friction with skin than conventional rigid polymers typically employed with razor heads. For example, suitable corrosion-resistant, resilient materials include Hercuprene 1000, 3000 series, Durometer 30 to 90 A Scale available from J-Von, Leominster, Mass.; Kraton G series, Durometer 30 to 90 A scale available from Shell Chemical Co., Lisle, Ill.; and Santoprene 2271 series, Durometer 30 to 90 A scale available from Monsanto, Co. Generally, thermoplastic elastomers, such as SEBS (ethylene butadiene mid blocks with styrene end blocks) and EPDM (ethylene propylene diene monomers) may be used. The most preferred materials will chemically bond with the rigid substrate/frame.

According to a still further embodiment of the present invention, at least one of said blades further comprises a wire wrap such as one of those disclosed in U.S. Pat. Nos. 1,035,548, 3,263,330, 3,505,734, 3,750,285 and 4,122,006, which are hereby incorporated by reference.

According to a preferred manufacturing method of the present invention, forward blade 20, middle blade 30 and rear blade 40 are positioned within a mold cavity. The thermoplastic material is then injected into the mold cavity in order to form blade support 21 around blade 20, blade support 31 around blade 30, and blade support 41 around blade 40. Each blade support is preferably formed with a torsion connector member such as connecting member 22. The use of torsion connecting members to attach the blade supports to the supporting cartridge support structure provides an easy to manufacture, dynamic shaving system wherein the blades are movable in response to forces encountered during shaving.

In addition to forming the blade supports around the rear portions of the blades, the cartridge support structure of this embodiment is also formed during this initial molding step. The resulting substructure may be transferred to another mold cavity or, more preferably, the mold cavity is modified in order to allow the subsequent injection of the material which will form the resilient forward guard member 70 and resilient side portions 80 of the support structure 50. Still further modification of the mold cavity can also be affected to allow a shaving aid 90 to be injected into the desired location(s).

According to another embodiment of the present invention, the blade support portion of the razor head comprises a support frame of a first material, preferably a rigid thermoplastic such as polypropylene or ABS which is formed with pockets. The pockets in the frame are designed to receive a second material, such as one or more of the resilient materials described above. According to a preferred aspect of this embodiment of the present invention, the portions of the cartridge support are adapted to receive torsion members of blade supports. This embodiment provides enhanced flexibility in the design and performance characteristic of such razor heads. For example, a first resilient material having one durometer can be utilized in connection with the first blade support while a second resilient material having a different durometer is positioned to affect the movement of a second blade support. In this manner, the movement of different blades can be different in response to equal forces. Furthermore, if desired, a third resilient material having a still different durometer may be used on skin-engaging surfaces. It is also within the scope of the present invention to utilize one resilient material on one skin-engaging surface and at least one other resilient material having a different durometer on another skin-engaging surface. From the present description, it will be appreciated that the use of one or more resilient materials, such as those described herein, advantageously provide three advantages to the shaving systems of the present invention. Initially, they can provide controlled dynamics, i.e., movement of one or more skin-engaging elements. Secondly, the resilient materials positioned proximate the connection of a movable skin-engaging element and the blade support frame provides a dampening effect thereby reducing the likelihood of blade chatter during shaving. Thirdly, the use of resilient materials on skin-engaging portions can provide sensory advantages during shaving by masking some of the unpleasant sensations commonly associated with shaving.

From the present description, it will also be appreciated that the torsion connecting members of the blade supports can be integrally formed with a rigid cartridge support structure which will serve as a substrate upon which the desired skin-engaging resilient material is connected. Alternatively, if the connecting members of the blade supports are received within receptacles of support structure side walls which are formed of a resilient material, it is preferable to form connecting members in a non-cylindrical shape so that the inherent memory of the resilient material will act upon the blade supports to return the blades to an original "home" position after external forces are removed from the blades. Conventional shaving angles and blade exposures may be utilized, if desired, or may be varied by changing the locations of the effective pivot points of the blades.

Figure 3:
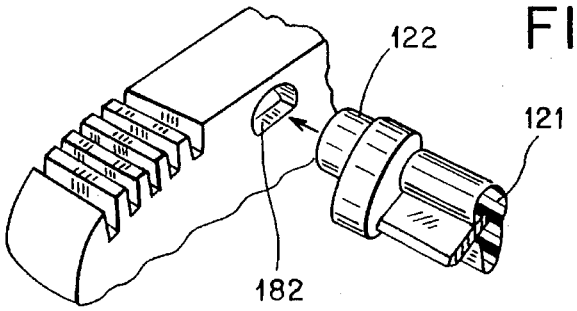
FIG. 3 is a partial perspective view of a blade support and complementary cartridge support structure receptacle of another embodiment of the present invention.
Figure 4:
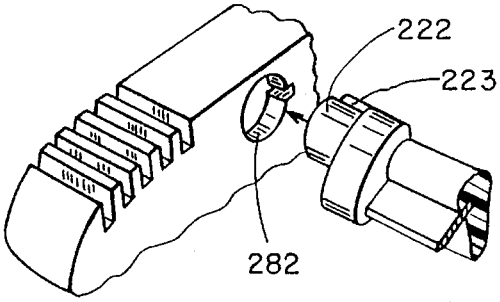
FIGS. 4 and 4A are a partial perspective views of a blade support and complementary cartridge support structure receptacle of still other embodiments of the present invention.
Figure 4A:
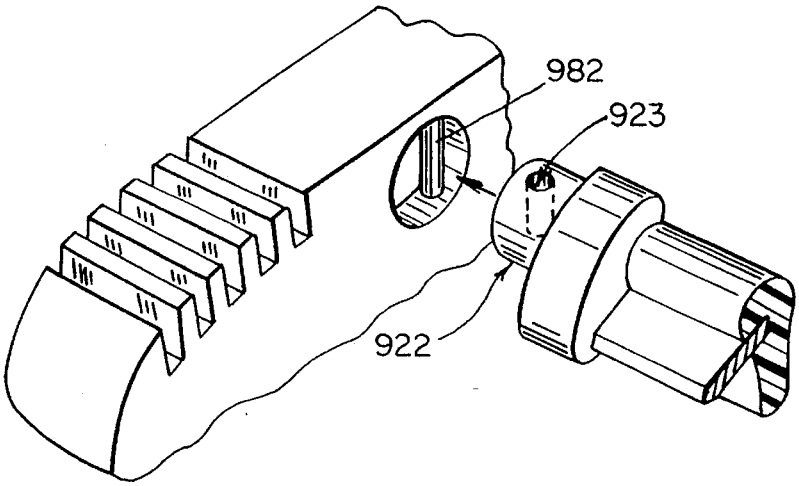

FIGS. 3, 4 and 4A illustrate blade supports of alternative embodiments of the present invention. In the embodiment of FIG. 3, at least one connecting pin 122 of blade support 121 has a semi-circular cross-section. According to this embodiment of the present invention, the blade support 121 is adapted to fit within a complementary semi-circular receptacle 182 formed on the interior surface of the side wall of the cartridge support structure. As stated above, it is most preferable that this semi-circular receptacle be formed of a resilient material, such as the same resilient material described above and used for resilient side portions 80 and/or resilient guard member 70 in the embodiment of the present invention illustrated in FIGS. 1 and 2. Use of such a resilient material to form the receptacle advantageously dampens vibratory motion imparted to the blade during shaving.

FIG. 4 illustrates a still further embodiment of the present invention wherein the connecting portion 222 of the blade support is formed in a substantially cylindrical shape with a key-shaped extension 223. According to this embodiment of the present invention, the connecting portion 222 is adapted to fit within a complementary key-shaped receptacle 282 on the interior surface of the side wall of the cartridge support structure. As in the embodiment illustrated in FIG. 3, the receptacle illustrated in FIG. 4 is also preferably formed of a resilient material for the reasons stated above.

FIG. 4A illustrates a still further embodiment of the present invention wherein the connecting portion 922 of the blade support is formed in a substantially cylindrical shape with a cylindrical hole 923 extending there through. According to this embodiment of the present invention, the connection portion 922 is adapted to fit within complementary cylindrical receptacle 982 on the interior surface of the side wall of the cartridge support structure. As in the embodiment illustrated in FIG. 3, the receptacle illustrated in FIG. 4A is also preferably formed of a resilient material for the reasons stated above and when injection molded around connecting portion 922, resilient material is molded into hole 923 so as to interlock the blade support structure with the resilient side wall structure but still allow structure 922 to rotate relative to the side wall structure.

The various embodiments of the present invention are designed for relative ease in manufacturing. For example, the side view of the embodiment of the present invention shown in FIG. 2 illustrates that most of the elements are formed with shapes defined by generally vertical lines. Those skilled in the art will appreciate that this design will facilitate formation of this razor head with vertically controlled mold members.

Figure 5:
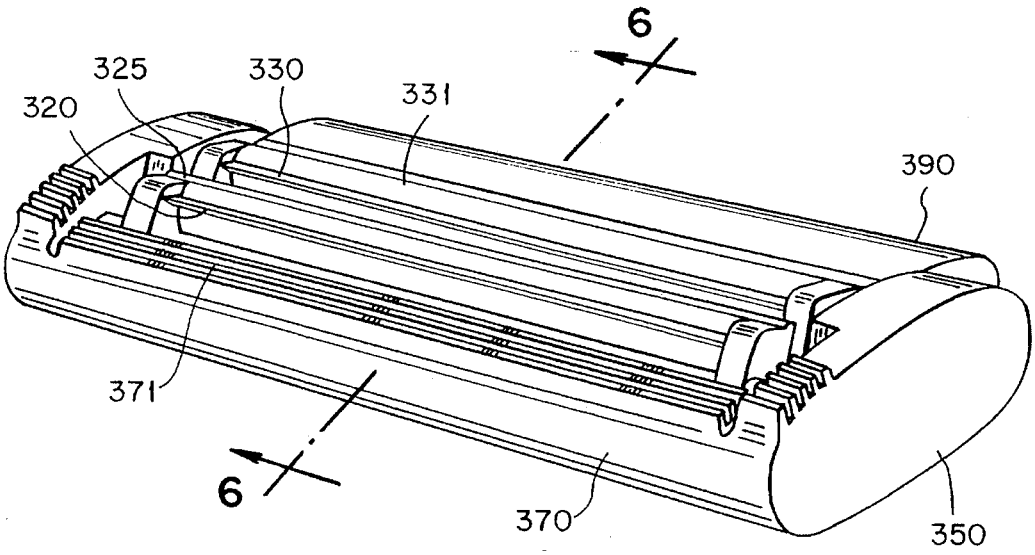
FIG. 5 is a perspective view of another embodiment of the present invention.
Figure 6:
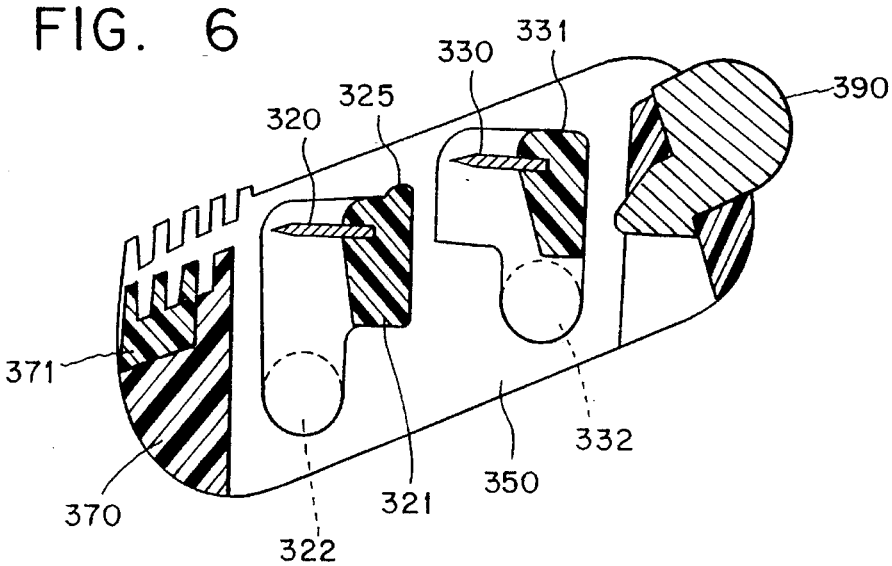
FIG. 6 is a cross-sectional side view taken along lines 6—6 of FIG. 5.

An alternative embodiment of the present invention is illustrated in FIGS. 5 and 6. This embodiment comprises a razor head having two blades, a forward blade 320 and a rear blade 330 which are supported by a blade support structures 321, 331, respectively. According to this embodiment of the present invention, only a first portion 371 of the guard member 370 is formed of a resilient material. The remaining portion of guard member 370 is formed of a more conventional, rigid material. This embodiment also differs from the embodiment shown in FIG. 2 in that shaving aid 390 extends from the top to the rear of the cartridge support structure 350. Furthermore, the pivotal connections 322, 332 between blade support structures 321, 331 and side wall 350 are positioned below the blades. According to this design, forces applied to forward blade 320 will generally cause the shaving angle to increase. Depending upon the relative position of the blade edge and the central axis of supporting pin, the blade exposure can either be caused to increase or decrease in response to forces encountered by the blade edge during shaving. According to the various embodiments of the present invention, it is not necessary to have both blades perform identically in response to similar functions. As best shown in the cross-sectional side view of FIG. 6, the positioning of blade edge of trailing blade 330 relative to support pin 332 is much more forward than the edge of forward blade 320 relative to blade support 322. According to this embodiment, trailing blade 330 will experience a greater increase in blade exposure than forward blade 320 for equal amounts of angular rotation.

Another aspect of this embodiment of the present invention comprises providing a movable guard 325 on forward blade support 321. Many conventional two blade shaving systems do not have face-engaging elements disposed between the forward and trailing blades and therefore the forward blade performs the function of a guard element to the trailing blade in that the forward blade controls the angle at which skin will contact the trailing blade. According to the illustrated embodiment of the present invention shown in FIGS. 6 and 7, guard surface 325 protrudes upwardly for skin-engaging contact and thereby reduces the span into which skin may flow before contacting the edge of trailing blade 330.

Figure 7:
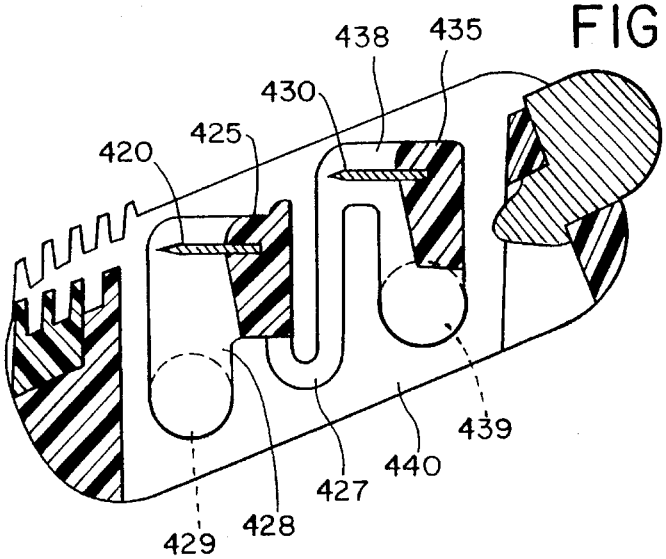
FIG. 7 is a cross-sectional side view of another embodiment of the present invention.
Figure 8:
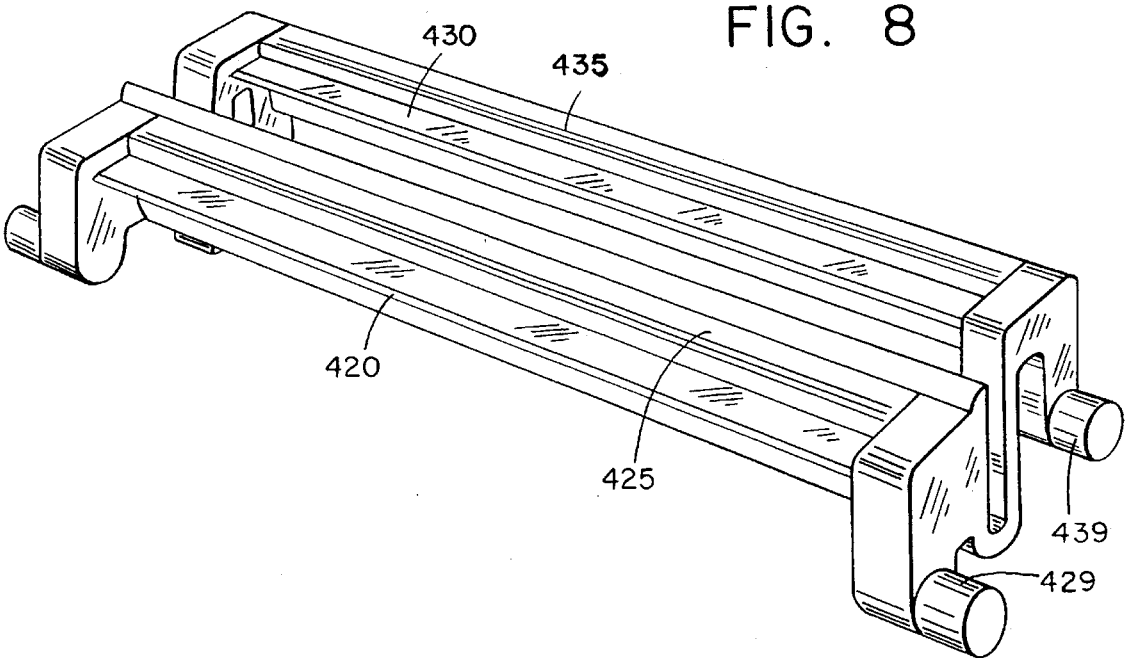
FIG. 8 is a perspective view of the blade support structure of the embodiment illustrated in FIG. 7.

Another embodiment of the present invention is similar to the embodiment shown in FIGS. 5 and 6 with the exception that the blade support structures are operatively connected. This embodiment, which is illustrated in FIGS. 7 and 8, comprises a razor head having two blades, a forward blade 420 and a rear blade 430, which are supported by a unitary blade support structure. As shown in FIG. 7, the blade support structure comprises a laterally extending forward support block 425 and rearward support block 435 for the blades which extend substantially for the entire length of the blades. Each blade block terminates in a rocking portion 428, 438 which is provided with a corresponding connecting pin 429, 439 for pivotal movement relative to the cartridge support structure 440.

According to this embodiment of the present invention, the rocking portions of each blade support are connected by a linking member 427. This linking member is utilized to translate forces and movement encountered by one blade to the other blade. Since the embodiment illustrated in FIG. 7 provides a pivot point for each blade which is disposed lower and more rearwardly than the cutting edges of the blade, forces encountered on either blade will tend to cause the shaving angle to increase and the blade exposure to increase in response to forces encountered during shaving.

It will be appreciated from the present description that by changing the relative position of the pivoting axes and the cutting edges of the blades, the effects on the blade exposure and shaving angle in response to forces encountered during shaving can be changed. For example, the pivoting pins can be positioned such that if the forward blade receives greater forces than the trailing blade and, in effect, is positioned to do more of the work, i.e., if the forward blade shaving angle increases and the exposure of the forward blade decreases slightly, the shaving angle of the trailing blade can be made to decrease while the blade exposure of the trailing blade decreases. Correspondingly, if the trailing blade is doing more of the work and shouldering more of the forces encountered by the blades during shaving, the exposure of the trailing blade can be made to decrease while the shaving angle of the trailing blade increases, causing a consequent increase in the exposure of the forward blade and a decrease in the shaving angle of the forward blade.

Figure 9:
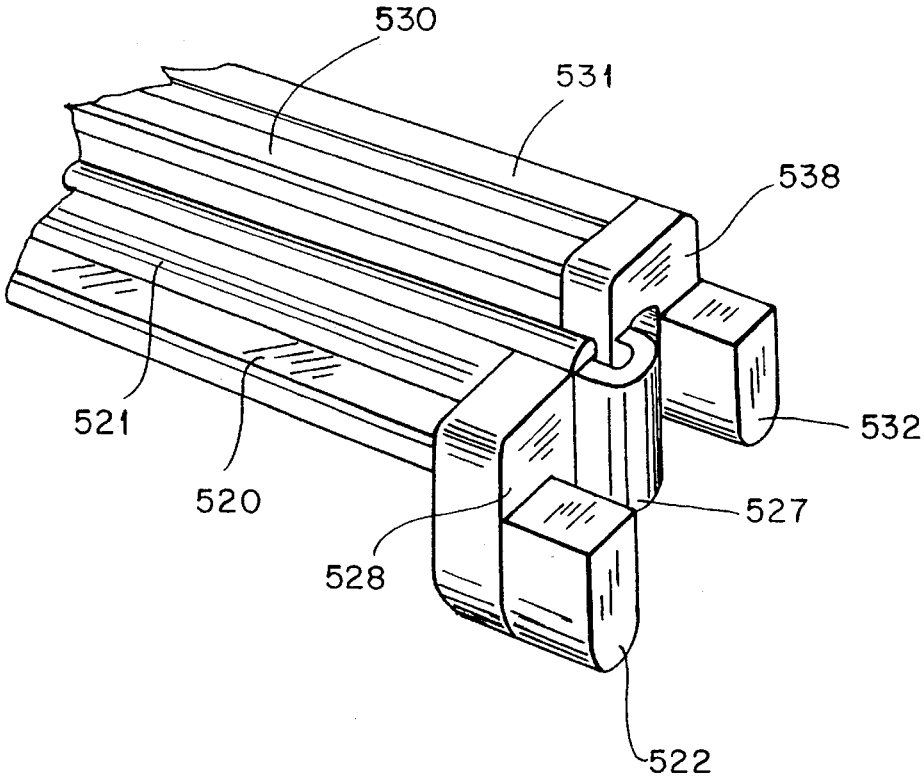
FIG. 9 is a partial, perspective view of the blade support structure of a still further embodiment of the present invention.

The blade supports can also be linked in an alternative fashion as shown in FIG. 9. According to this alternative embodiment of the present invention, a generally horizontally positioned linking member 527 is utilized to connect rocking portions 528 and 538 of blade supports 521 and 531, respectively. According to this embodiment of the present invention, rearwardly directed forces encountered by forward blade 520 will tend to cause trailing blade 530 to shift laterally with less rotation than in previously described embodiments. According to this embodiment of the present invention, the support pins 522, 532 are formed of a resilient material in order to allow some relative shifting of the entire blade support relative to the side walls of the cartridge support.

While illustrated embodiments of the present invention comprise at least two blades which are pivotally supported within a razor head, advantages of the present invention may also be attained with a single blade razor head. Those skilled in the art will readily appreciate that each of the illustrated embodiments can be readily adapted to a single blade system. Furthermore, the advantages achieved by the embodiment of the present invention shown in FIGS. 1 and 2 wherein a resilient side portion is positioned for skin-engaging contact is applicable to shaving systems having fixed blades, as well as to single blade systems.

What is claimed is:

1. A razor head comprising:

a support structure;

at least one blade movably supported relative to said support structure, said blade having a sharpened edge which defines a cutting path when said razor head is drawn across a skin surface during shaving;

said blade operatively connected to said support structure by means for movably connecting said blade to said support structure;

said connecting means comprising at least one portion formed of a resilient material;

wherein said connecting means comprises a blade support connected to said blade, said blade support comprising a pin;

said connecting means further comprising a receptacle for receiving said pin, defined by said support structure;

wherein at least one of said pin or said receptacle comprise a resilient material; and wherein said blade support pin has a semi-circular cross-section.

2. A razor head comprising:

a support structure;

at least one blade movably supported relative to said support structure, said blade having a sharpened edge which defines a cutting path when said razor head is drawn across a skin surface during shaving;

said blade operatively connected to said support structure by means for movably connecting said blade to said support structure;

said connecting means comprising at least one portion formed of a resilient material;

wherein said connecting means comprises a blade support connected to said blade, said blade support comprising a pin;

said connecting means further comprising a receptacle for receiving said pin, defined by said support structure;

wherein at least one of said pin or said receptacle comprise a resilient material; and wherein said blade support pin has a non-circular cross-section.

3. A razor head according to claim 1 wherein said receptacle defined by said support structure comprises a resilient material.

4. A razor head according to claim 1 wherein said resilient portion comprises a material selected from the group consisting of SEBS and EPDM.

5. A razor head comprising:

a support structure;

at least one blade movably supported relative to said support structure, said blade having a sharpened edge which defines a cutting path when said razor head is drawn across a skin surface during shaving;

said blade operatively connected to said support structure by means for movably connecting said blade to said support structure;

said connecting means comprising at least one portion formed of a resilient material;

wherein said at least one blade comprises a plurality of operatively connected blades wherein movement of a first blade causes movement of a second blade; and wherein said first blade is supported by a first blade support and is disposed forwardly of said second blade, and wherein said first blade support comprises a face-engaging portion disposed between said first blade and said second blade.

* * * * *